United States Patent [19]

Jaconelli et al.

[11] Patent Number: 4,905,451

[45] Date of Patent: Mar. 6, 1990

[54] STRIP HAVING A LONGITUDINAL REINFORCEMENT, ITS PRODUCTION AND ITS USE IN A PACKAGING METHOD, AND A DEVICE FOR THE PRODUCTION OF SUCH A STRIP

[75] Inventors: Georges Jaconelli, Aix Les Bains; Jean-Paul C. Martin-Cocher, La Motte Servolex, both of France

[73] Assignee: Newtec International, Aix-Les Bains, France

[21] Appl. No.: 210,972

[22] Filed: Jun. 24, 1988

[51] Int. Cl.[4] ..... B65B 61/00; B65B 11/04

[52] U.S. Cl. ..... 53/410; 53/211; 53/461; 53/587; 493/440

[58] Field of Search ..... 53/410, 587, 588, 211, 53/465, 204, 399, 416, 419, 214, 397, 461, 176; 493/439, 440, 438, 89

[56] References Cited

U.S. PATENT DOCUMENTS

| | | | |
|---|---|---|---|
| 3,296,986 | 1/1967 | Gansl | 493/440 X |
| 3,917,254 | 11/1975 | Watrous | 493/440 X |
| 4,137,690 | 2/1979 | Morgan | 53/176 |
| 4,395,255 | 7/1983 | Branecky et al. | 493/446 X |
| 4,432,185 | 2/1984 | Geisinger | 53/587 X |
| 4,534,151 | 8/1985 | Schneck et al. | 53/211 X |
| 4,565,049 | 1/1986 | DeLigt et al. | 53/415 |
| 4,754,594 | 7/1988 | Lancaster | 53/587 X |
| 4,795,417 | 1/1989 | O'Connell | 493/440 X |

*Primary Examiner*—James F. Coan

*Attorney, Agent, or Firm*—Mason, Fenwick & Lawrence

[57] ABSTRACT

The invention relates to a strip having a longitudinal reinforcement; a packaging method comprising such a strip; an installation and a machine for implementing the packaging method and a device for the production of such a strip. This flexible strip (1), which is more specifically applicable to the construction of packaging, constituted more specifically by a plastic film, of the integrally produced type, wherein it possesses at least one longitudinal zone of reinforcement (2) constituted, at least in part, by N longitudinal zones of folding (3*a*, 3*b*, 3N) of the strip (1), adjacent to one another, overlapping one another at least substantially flatly, at least in part, in a single longitudinal region of the strip (1), N being a positive integer at least equal to two.

19 Claims, 9 Drawing Sheets

STRIP HAVING A LONGITUDINAL REINFORCEMENT, ITS PRODUCTION AND ITS USE IN A PACKAGING METHOD, AND A DEVICE FOR THE PRODUCTION OF SUCH A STRIP

The invention relates to a strip having a longitudinal reinforcement, its production and its use.

Various methods and installations for packaging rolls of paper, and more generally for packaging heavy loads (capable of reaching a ton in weight) of generally cylindrical shape having a horizontal axis, are already known. In a technique which is known in practice, corner pieces, for example of card, are initially placed on the two end edges of the cylindrical surface of the load, which edges are of circular shape, the function of these corner pieces being to protect the edges against impacts and hence to prevent the deterioration of the load, which in the present case is paper. The cylindrical surface of the load is then wrapped with and in a strip of film or of paper which is sufficiently tightened on the load and holds the corner pieces. If appropriate, the corner piece is held by strapping with a metallic strip. Such a corner piece may possess transverse slits in its section intended to be applied to the end surface of the load, in a manner such as to fit closely with the curved contour of the corresponding edge of the load. Other practices are known from the state of the art (in particular the documents U.S. Pat. No. 4,137,690, U.S. Pat. No. 4,565,049, FR No. 2,403,267, FR No. 2,449,035, FR No. 2,449,037, FR 2,504,491 and DE No. 2,417,563). However, these other technologies are not successful in providing a simple and effective solution to the problem of the strapping or the problem of partial covering of the cylindrical surface of the load and, if appropriate, the covering of the end surfaces, and the problem of protecting the end edges of the load In another practice (document U.S. Pat. No. 3,412,524) intended for the packaging of a roll of coins, the projecting part of the packaging film is folded back, being creased against the end face of the roll. In yet another practice (document U.S. Pat. No. 2,893,191), the reinforcing corner pieces are fixed by means of adhesive to the film packing the cylindrical surface of the load.

It is also known, moreoever, to produce longitudinal folds on a strip of film (documents EP No. 0,068,341, U.S. Pat. No. 4,395,255, FR No. 2,507,962, FR No. 2,507,963 and FR No. 2,283,825 and also prior art for the production of plastic bags from a strip of film). If the production of longitudinal folds is associated with packaging, this is not, according to the state of the art, with a view to being applied to loads such as rolls of paper as a protective expedient, particularly for the edges.

The production of a packaging cover reinforcement by means of a transverse fold in the cover (documents FR No. 2,566,739 and BE No. 487,976), or the production of a strip-type reinforcement by doubling the thickness of the latter arranged in two layers, these two layers merely being superposed, is likewise known.

The invention relates to a strip such as that which can be applied more specifically to form a packaging, formed for example by a film of plastic of the integrally produced type with which a reinforcement may be associated, and also to a method and a device for producing the said strip.

Further subjects of the invention are a packaging method and a packaging making use of such a strip; and particular applications of packaging of this type, namely on the one hand the packaging of a load of generally cylindrical shape having a horizontal axis of revolution such as a roll of paper, and on the other hand the strapping of a palletized load.

A strip such as that in question possesses at least one longitudinal zone of reinforcement comprising, at least in part, N longitudinal zones of folding of the strip, adjacent to one another, overlapping each other at least substantially flatly, at least in part, in a single longitudinal region of the strip, N being a positive integer at least equal to two.

A packaging for a load comprises at least one such section of strip in the longitudinal direction. More specifically, this section of strip is applied to the packaged load, in a manner such that a longitudinal zone of reinforcement of the section of strip is located at the point where the packaging is to be reinforced or the load further protected or at any other desired point.

A method of packaging such a load comprises the different stages in which a flexible strip having a longitudinal reinforcement is unrolled, a relative displacement of the strip is carried out in relation to the load to be packaged in a manner such that the strip is applied to the load, and the strip is rigidly joined to itself and/or to the load. More specifically, either a strip lacking any reinforcement is unrolled in order successively to produce, first, continuously the longitudinal reinforcement and then to apply the strip thus reinforced to the load; or a strip having a longitudinal reinforcement and wound into a roll is unrolled and applied to the load.

One possible method for continuously producing such a reinforcement on a strip is such that a strip of single thickness, which is continuous as a whole initially and lacking any reinforcement, is passed in a longitudinal direction in accordance with a relative movement, and, in at least one phase of longitudinal folding, at least two adjacent longitudinal zones of folding of the strip are progressively, in the longitudinal and transverse directions, brought to overlap flatly one on the other in order to form at least one longitudinal fold constituting at least one part of the zone of longitudinal reinforcement.

A device for carrying out this method possesses means for continuously feeding a strip lacking any reinforcement, for driving this strip in a longitudinal movement, and for evacuating the reinforced strip; means for maintaining the strip under tension in the longitudinal direction; at least a first and a second runner, longitudinally extended but limited, which in their active state have their extreme downstream parts at least partly superposed and set at a distance apart from one another in the direction perpendicular to their plane, their function being to shape the strip which slides over them in a manner such that these superposed and spaced downstream parts produce the overlapping of the longitudinal zones of folding of the strip.

According to another possible method for continuously producing such a reinforcement, a sheath is initially taken comprising at least one longitudinal gusset, and the sheath is split longitudinally and opened, the gusset being retained.

A particular case of a packaging method for the application of packaging a roll of paper is such that the load has a generally cylindrical shape, in particular with its axis of revolution aligned horizontally, and the film is of the type which can be stretched; in at least one optional first phase, the strip is unrolled without its being necessary to produce a reinforcement thereon and this strip is applied to at least one part of the cylindrical surface of the load and, in at least one second phase, the strip is unrolled, and a longitudinal reinforcement is produced thereon, and this strip with reinforcement is applied with its reinforcement to an end edge of the cylindrical surface; at least during the second phase or second phases, the film is stretched or pre-stretched, the effect of which is to apply this film to the end face or faces of the load; the strip of film is cut transversely and its extreme end part is fixed to the load and/or to the intermediate part of the strip of film already applied to the load. An installation for carrying out this method possesses support means for a roll of film strip having a horizontal axis, motorized means for supporting the load capable of permitting it to pivot about its axis of revolution; a device for the continuous production of a longitudinal zone of reinforcement on the film strip, interposed between the means for supporting the roll, or the roll of film strip itself, and means for supporting the load, or the load itself, the film strip passing longitudinally in this device; means for transversely cutting the film strip; means for fixing the film strip to itself and/or to the load; means for ensuring relative horizontal sliding of the device and of the load support means parallel to the axis of the load; and means for stretching or pre-stretching the film.

Another particular case of a packaging method for strapping application is such that, the load is of a generally parallelepipedal shape, particularly with its axis positioned vertically, this load being in particular a palletized load, and the film is of the stretchable type; in at least one phase, the strip is unrolled, a longitudinal reinforcement is produced thereon and this strip with reinforcement is applied to the load and, simultaneously, the film is stretched or pre-stretched. A machine for carrying out this method possesses support means for a roll of film strip having a vertical axis; load support means; means for operating a relative displacement of the support means for the roll of film strip, or of the roll of film strip and the load support means, or of the load, pivotably about a vertical axis; a device for continuously producing a reinforcement on the film strip, interposed between the support means for the roll of film strip, or the roll of film strip, and the load support means, or the load itself, the film strip passing longitudinally in this device; means for transversely cutting the film strip; means for fixing the film strip to itself and/or to the load; and means for stretching or pre-stretching the film.

The invention is based on the concept of a strip of film with which is integrated a homogeneous longitudinal reinforcement comprising one or more longitudinal folds, that is to say one or more superposed layers or thicknesses of film. Such a strip can be continuously produced from a conventional strip of the prior art. The positioning of the reinforcement in the longitudinal or transverse direction, its transverse extent and its bulk (number of superposed layers) permit numerous alternative embodiments as required. This reinforcement makes it possible to confine a solid, liquid or gaseous body. The strip and its longitudinal reinforcement form an integral, indissoluble whole, which distinguishes the strip according to the invention from two layers of strip which are simply superposed.

In the method of packaging a roll of paper, the same roll of film and the same installation are used for packaging the cylindrical face and the end faces.

The other features and advantages of the invention will be apparent from the description which follows, with reference to the attached drawings, in which.

Figure 2:
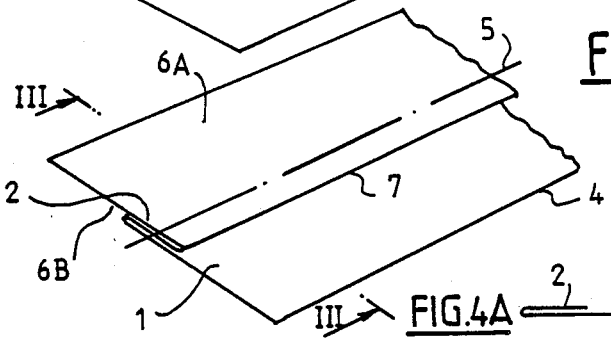

The invention relates first to a flexible strip 1, which can be applied more specifically but not exclusively to the construction of packaging, constituted more specifically by a plastic film of the integrally manufactured type. This strip 1 possesses at least one longitudinal zone of reinforcement 2 constituted, at least in part, by N longitudinal zones of folding 3*a*, 3*b* . . . 3N of the strip 1, adjacent to one another, overlapping one another substantially flatly, at least in part, in a single longitudinal region of the strip 1, N being a positive integer at least equal to two (FIG. 2).

Figure 1:
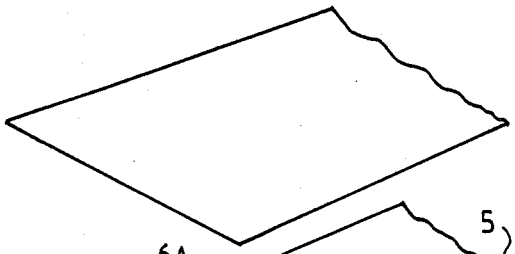
FIG. 1 and FIG. 2 show a section of film strip, respectively from the known state of the art and according to the invention.
Figure 3:
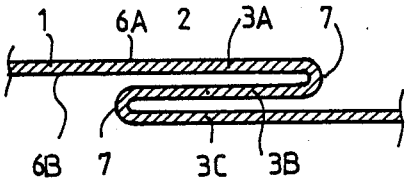
FIG. 3 is a view in cross-section along the line III—III in FIG. 2, showing a possible form of reinforcement according to the invention on a larger scale.
Figure 4A:
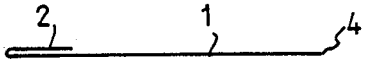
FIGS. 4A to 4K are eleven diagrammatic views in cross-section illustrating various alternative embodiments of a reinforcement according to the invention.

Such a strip 1 according to the invention may be compared to a strip from the known state of the art according to FIG. 1. The strip according to the known state of the art is integrally manufactured and possesses a single thickness over its entire surface, the physical properties of the strip being homogeneous or more or less homogeneous over its entire surface, both in the longitudinal direction and in the transverse direction. These properties are in particular the thickness, the shock-absorbing power, etc. . . . By contrast, the strip 1 according to the invention possesses a longitudinal zone of reinforcement integrated into the strip 1 and produced by the strip 1 itself, as a consequence of its longitudinal folding. The strip 1 according to the invention thus contrasts, in this respect, with other strips likewise known from the state of the art in which a reinforcement is applied to the strip. The strip 1 was two longitudinal edges 4 parallel to the longitudinal axis 5 of the strip 1. In the remainder of the description the "transverse" direction will be understood to mean a direction perpendicular to the longitudinal axis 5 and in the plane of the strip 1. The strip 1 defines a sheet having two opposite major surfaces, respectively 6A and 6B (for example the front and the reverse. Two (or more) longitudinal zones of folding 3A, 3B, which are mutually adjacent and overlap at least substantially flatly, are understood to mean the production within the strip 1 of a longitudinal fold 7, parallel to the longitudinal axis 5 separating the two zones 3A, 3B which are themselves likewise longitudinal and in contact by their same surface 6A or 6B or having their same surfaces 6A or 6B facing one another. In the simplest form of embodiment, the zone of longitudinal reinforcement possesses two longitudinal zones of folding 3A and 3B and a single fold 7 (FIG. 4A). In the most general or most frequent form of embodiment, the longitudinal zone of reinforcement possesses three superposed longitudinal zones of folding 3A, 3B, 3C and two folds 7A, 7B which are at a distance apart from one another transversely (FIG. 3).

The zone of reinforcement 2 is understood to mean the fact that in this zone of the strip 1, the strip 1 possesses a greater number of film thicknesses than in the remainder of the strip 1. The flat overlap is understood to mean the fact that the longitudinal zones of folding 3A, 3B are applied to one another or turn towards one another in a manner such that the strip 1 retains, despite the presence of the longitudinal zone of reinforcement, a general shape of a plane strip, which is simply thicker at the point of the reinforcement thus formed.

A longitudinal zone of reinforcement 2 may be used functionally in numerous possible ways, either for its qualities of strength or in that it constitutes an excess thickness relative to the remainder of the strip 1 having an anti-shock protection function. These functions and others are utilized in the various possible applications of such a strip 1 according to the invention.

Figure 4B:
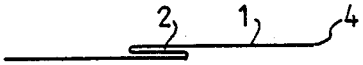
Figure 4C:
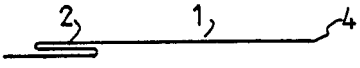
Figure 4D:
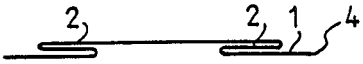
Figure 4E:
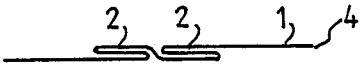
Figure 4F:
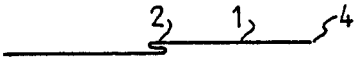

The strip 1 having a reinforcement 2 according to the invention may be the subject of numerous alternative embodiments: a longitudinal zone of reinforcement 2 may be adjacent or close to the longitudinal edge 4 of the strip 1, or in or close to the median longitudinal part of the strip 1, or situated in a lateral part of the strip 1, between its longitudinal axis 5 and a longitudinal edge 4 (FIGS. 4A, 4B, 4C respectively). The strip 1 may possess either a single longitudinal zone of reinforcement 2 or a plurality of longitudinal zones of reinforcement 2 (respectively FIG. 4B in particular and FIG. 4D or 4E). In the case where a plurality of longitudinal zones of reinforcement 2 exist, they may be either adjacent or at a distance from one another transversely (FIGS. 4E and 4D respectively). Preferably, but not limitingly, the strip 1 is characterized by a symmetrical or substantially symmetrical arrangement of the longitudinal zone or zones of reinforcement 2 relative to the median longitudinal axis 5 of the strip 1 (FIGS. 4B, 4D to 4K) as opposed to an asymmetrical arrangement (FIGS. 4A, 4C).

Figure 5A:
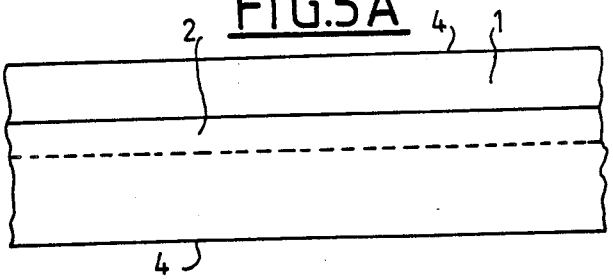
FIGS. 5A and 5B are two diagrammatic views in elevation of two alternative embodiments of the invention illustrating the reinforcement in the longitudinal direction.
Figure 5B:
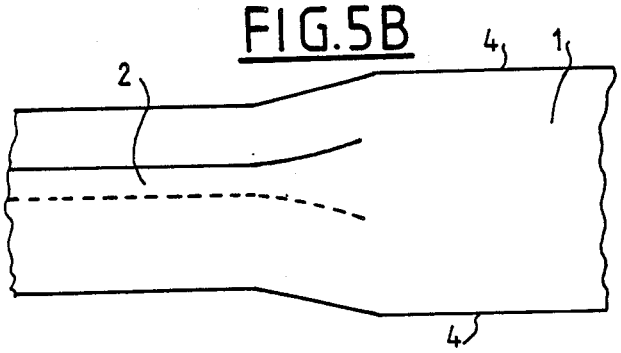
Figure 8:
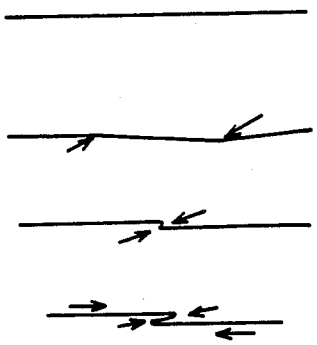
FIG. 8 is a diagrammatic view of the method of producing the reinforcement.

According to another feature, the strip 1 is characterized by an arrangement of a zone of reinforcement 2 which in the longitudinal direction is either continuous or discontinuous and arranged in distinct longitudinal sections which are in particular separate from one another and more or less extensive in the longitudinal direction (FIGS. 5A and 5B respectively).

The possibility of having longitudinal zones of reinforcement 2 which are limited longitudinally with no break or discontinuity of the strip 1 is an important and advantageous feature of the invention. It permits great versatility in the use of such a strip 1.

According to another feature, the strip 1 is characterized by an arrangement of a longitudinal zone of reinforcement 2 which may be longilinear or substantially longilinear or curvilinear, or may be extended transversely (FIG. 4F and FIGS. 3, 4A, 4B, 4C respectively). A longilinear or substantially longilinear or curvilinear arrangement is understood to mean the fact that the transverse dimension of the overlapping zones of folding 3A and 3B is very slight in its absolute width or in its relative width compared to the width of the strip 1 or alternatively compared to its thickness. In this case, the longitudinal zone of reinforcement 2 is similar to a longitudinal rib.

Figure 4G:
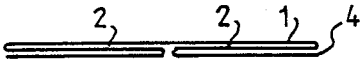

According to another feature, the strip 1 is characterized by an arrangement of a longitudinal zone of reinforcement 2 on the strip 1 which is either localized or transversely extended over all or merely part of the transverse width of the strip 1 (for example, FIGS. 4B and 4G respectively). In the case of a localized arrangement, the zone of reinforcement 2 occupies only a small part of the strip 1 in the transverse direction. By contrast, the zone of reinforcement 2 may occupy a substantial part of the width of the strip 1 or all that width.

Figure 4H:
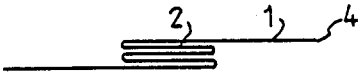
Figure 4I:
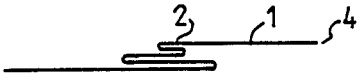
Figure 4J:
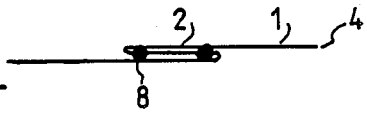

According to another feature, the N longitudinal zones of folding 3A, 3B, . . . 3N constituting the longitudinal zone of reinforcement 2 are either of the same transverse width and superposed, thus forming a longitudinal reinforcement 2 of constant thickness in the transverse direction, or offset and/or of different widths, thus forming a longitudinal reinforcement 2 of variable thickness in the transverse direction (FIGS. 4H and 4I respectively). In particular, in this latter case, such a reinforcement 2 possesses a greater thickness in its median longitudinal line and a lesser thickness on its longitudinal edge with, in particular, a thickness which decreases from the median longitudinal line to the longitudinal edge. This structural feature of the strip 1 is important and advantageous since it makes it possible to produce a more or less substantial longitudinal zone of reinforcement 2 depending on the positioning in the transverse direction.

According to a possible and optional embodiment, the longitudinal zones of folding 3A, 3B . . . are fixed together, in particular by a weld 8 (FIG. 4J), this weld 8 being in the form of spots or zones, or lines and continuous or discontinuous. This embodiment is well suited to the case where the strip 1 is intended to be stored temporarily (that is to say between its manufacture and its use), particularly when it is intended to be rolled. It then avoids the dissolution of the longitudinal zone of reinforcement 2. In the case where the longitudinal zone of reinforcement 2 is produced immediately before the utilization of the strip 1 thus reinforced — as is described below — it is possible to dispense with such weld joints 8, the application of the strip 1 to the load to be packaged (in the case of an application to packaging by application) being sufficient to prevent the dissolution of the longitudinal zone of reinforcement 2. This is an important feature of the invention.

Figure 4K:
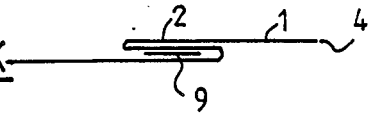

According to a possible and optional embodiment, a body 9 is incorporated in a longitudinal zone of reinforcement 2 by being inserted between two adjacent longitudinal zones of folding 3A, 3B (FIG. 4K). This body 9 is for example a gas, particularly air, or a filament or strip cut off from the strip 1 or elsewhere, or a liquid or a paste, or an information or advertising medium, or a stiffening element or additional reinforcing element, or a shock-absorbing element such as plastic foam. Preferably, this form of embodiment with body 9 inserted is combined with the previous form, welding in particular, in a manner such as to ensure effective positive confinement of the body 9 in the longitudinal zone of reinforcement 2. This is generally essential in the case where the body 9 is a gas, a liquid or a paste.

If appropriate, one or more longitudinal lines of weakness for the longitudinal tearing of the strip 1 can be provided at the location of a longitudinal zone of reinforcement 2 or possibly outside such a zone.

According to another feature, the film of plastic constituting the strip 1 is either heat-shrinkable or cold-stretchable, particularly in the longitudinal direction.

According to another feature, the film constituting the strip 1 is either continuous (without significant perforations) or discontinuous, particularly in the form of a net, or with macro-perforations.

To the extent that it may be possible and desirable, the various alternative embodiments described above may be combined with one another. Such combinations are understood as being "parallel" over a single longitudinal section of strip 1 or "serial" over different longitudinal sections of strip 1.

The strip 1 according to the invention can likewise possess the other generally known features for conventional strips of the state of the art, particularly the existence of transverse tear lines or transverse reinforcements, particularly by means of transverse folding.

Finally, it is understood that the concept of strip 1 covers, as a general case and in the simplest embodiment, a strip originally of single thickness as has been generally described but also, more generally, any sheet of film disposed in a manner other than as a strip, and also a strip constituted by a complex of a plurality of films, or alternatively a flat sheath which corresponds to two superposed strips joined to one another. Such a flat sheath may be of the type having longitudinal gussets. In this case, these gussets may themselves, being laid flat, constitute the longitudinal zones of reinforcement 2 according to the invention. This shape of sheath, particularly having gussets, is the shape of the strip 1 either finally, that is to say ready for use, or originally, with a view to the subsequent production of the longitudinal zone of reinforcement 2.

Finally, it must be understood that the "longitudinal" character comprises not only the interpretation given above but also, more generally, is understood as a direction in which the film extends over a very great length relative to its width.

The invention relates, furthermore, to a packaging for a load 10 possessing at least one longitudinal section of a strip having a longitudinal zone of reinforcement 2 such as has just been described.

Figure 6:
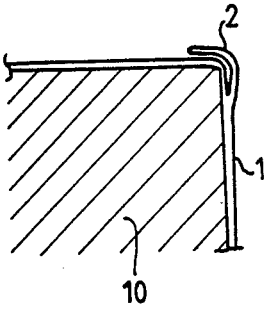
FIG. 6 is a partial diagrammatic view in cross-section illustrating a packaging according to the invention and the function of the reinforcement.

In general, the section of strip 1 is applied to the packaged load 10, a longitudinal zone of reinforcement 2 of the section of the strip 1 being situated at the point where the packaging is to be reinforced or the load 10 further protected. However, the reinforcement may be situated at other desirable points, depending on requirements and on the function fulfilled by the zone of reinforcement 2, possibly with the body 9 inserted. Preferably, a longitudinal zone of reinforcement 2 is applied to a projecting zone of the load 10, particularly an angle, a corner or an edge (FIG. 6). The section of strip 1 may likewise form part of the packaging without being applied to the load. If appropriate, the section of strip 1 may be positioned at the point where the packaging is to be opened, very particularly in the case where the film strip 1 possesses an opening filament 9 and/or tear lines. As has already been indicated, the application of the section of strip 1 to the load 10 and particularly to a projecting zone makes it possible for the longitudinal zone of reinforcement 2 to be maintained without the need for additional fixing.

The invention likewise relates to a method of packaging in order to produce such a packaging. Such a method comprises various stages in which a flexible strip 1 having a longitudinal zone of reinforcement 2 is unrolled, the strip 1 undergoes a relative displacement in relation to the load 10 to be packaged, particularly with a view to applying the strip 1 to the load 10, and the strip 1 is rigidly affixed to itself and/or to the load 10 (FIG. 7).

Figure 7:
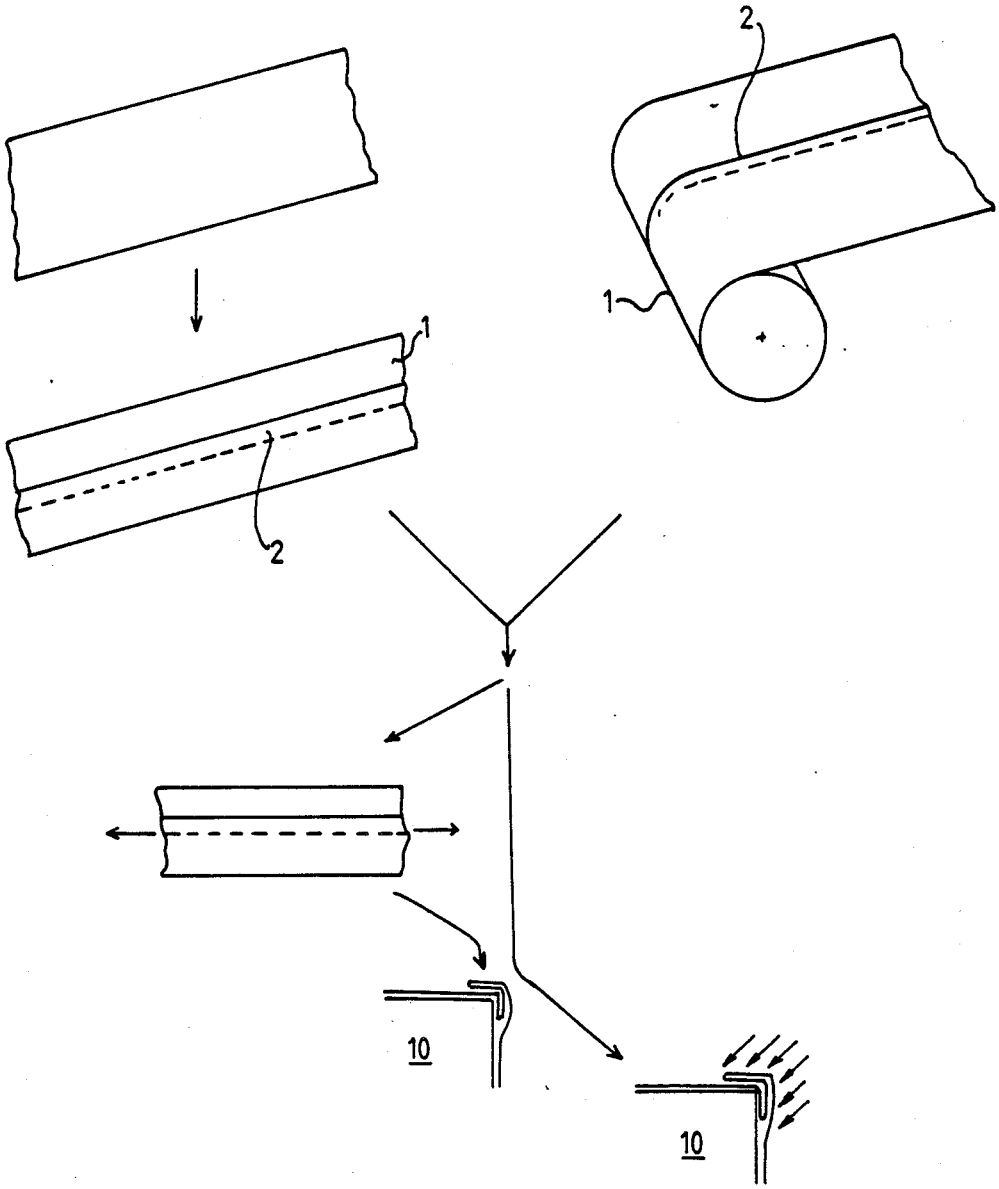
FIG. 7 is a diagrammatic view of the packaging method according to several possible alternative embodiments.

According to a first alternative embodiment, a strip (of a single thickness, which also comprises the case of a flat sheath, as has already been seen) lacking any reinforcement is is unrolled (more generally, the strip is the subject of a feeding operation) in order initially to produce successively, and in particular continuously, the longitudinal zone(s) of reinforcement 2, and then to apply the strip thus reinforced to the load 10 (top left-hand part of FIG. 7). According to a second alternative embodiment, a previously produced strip, particularly wound into a roll, having a longitudinal reinforcement 1 is drawn out, in particular unrolled, and it is applied to the load 10 as before (top right-hand part of FIG. 7). Consequently, the stage of producing the longitudinal zone of reinforcement 2 is either integrated in the packaging method or distinct, the packaging method then employing a reinforced strip 1 prepared separately and presented, for example, in a roll.

According to a first possible embodiment, a cold-stretchable plastic film is used and the strip 1 is stretched longitudinally during its application to the load 10, in particular either conventionally by the load 10 itself (conventional stretching) or by pre-stretching (the stretching then being dissociated from the load and carried out immediately before application) (bottom left-hand part of FIG. 7).

According to a second possible embodiment, a heat-shrinkable plastic film is used and the strip 1 is heated after application to the load 10 (lower right-hand part of FIG. 7).

In both cases, the effect of this stage of the packaging method is to ensure the tight application of the strip 1 to the load 10 and, in addition, the rigid association of the longitudinal zone of reinforcement 2 with the remainder of the strip 1.

Finally, according to another feature of the packaging method according to the invention, utilizing the feature of the strip 1 of possessing a longitudinal zone of reinforcement 2 or of lacking such a zone, the packaging method comprises, optionally and if necessary, at least one phase during which a zone of reinforcement 2 is produced and at least one phase during which such a zone 2 is not produced, the strip delivered and utilized in this phase thus lacking such a zone of reinforcement 2, the strip being continuous between a section where it possesses a zone of reinforcement 2 and a section where it lacks such a zone.

Naturally, and to the extent that it is possible and desirable, the various alternative embodiments described can be combined with one another.

A feature of such a packaging is that the reinforcement is longitudinal, integrated in the strip 1 itself, and that it can be placed at any desired point on the load 10, including for example on an edge or a corner, by virtue of the presence of the part of strip 1 lacking a zone of reinforcement 2 placed on either side of this zone 2 and forming a support. Finally, the zone of reinforcement 2 makes it possible to benefit from the functions fulfilled by this reinforcement (gripping strength, antishock, etc. . . . .).

Furthermore, the invention relates to a method for producing such a longitudinal zone of reinforcement 2 on a strip.

The method may be discontinuous and relate to a limited and finite longitudinal section of strip. In this case, the method consists in producing a longitudinal folding of the strip, generally progressively in the transverse direction and over the entire longitudinal section in question.

The method may, preferably, be continuous and relate to a section of strip of very great length, either unlimited or continuous.

In this latter case, according to a first alternative embodiment, it is possible to take initially a strip of single thickness, continuous overall, initially lacking any reinforcement; in a longitudinal direction in accordance with a relative movement and in at least one phase of longitudinal folding, at least two adjacent longitudinal zones of folding 3A, 3B of the strip are brought progessively, in the longitudinal direction and/or in the transverse direction, to overlap one another flatly in order to form at least one longitudinal fold constituting at least a part of the longitudinal zone of reinforcement 2. The single-thickness strip may alternatively be produced from a longitudinally split sheath, without affecting the subsequent method according to the invention.

According to a second alternative embodiment, a strip in the form of a sheath having a longitudinal gusset and continuous overall is unrolled in the longitudinal direction according to a relative movement and in at least one phase of longitudinal opening, the sheath is split longitudinally and the sheath is opened in the transverse direction, the gusset being retained, at least partially, in a manner such that the open sheath forms a flat strip whose longitudinal gusset constitutes the longitudinal zone of reinforcement 2. This second alternative embodiment takes advantage of the known existence of conventional sheaths having gussets.

In the text, and in particular in what follows, it is considered that the word strip covers the two alternative embodiments (single-thickness strip or sheath).

In the first alternative embodiment, the longitudinal zone of reinforcement 2 is essentially produced during the phase of longitudinal folding and, in the second alternative embodiment, during the phase of opening and flattening.

Preferably, during and at least immediately after the phase of longitudinal folding or after the phase of longitudinal opening, the strip 1 is held flat under tension in the longitudinal direction. This tension aims to preserve the integrity of the longitudinal zone of reinforcement 2 without the need for positive retaining means, particularly for fixing (such as welding).

In a possible embodiment of the invention, after the last phase of longitudinal folding or of longitudinal opening, the strip 1 having a longitudinal zone of reinforcement 2 is applied to and maintained on a support. For example, it is possible to use as a support a roll on which the strip 1 having a longitudinal zone of reinforcement 2 is rolled, or at least one mobile roller of a machine making use of the strip 1 having a longitudinal reinforcement and on which this strip moves longitudinally, or a load 10 which is to be covered by the strip 1 having a longitudinal reinforcement, notably a load to be packaged.

In another form of embodiment, as already described, the reinforced strip 1 is applied to a load 10 with a view to packaging as soon as the longitudinal zone of reinforcement 2 is formed.

In another form of embodiment, fixing, particularly welding, of the longitudinal zones of folding 3A, 3B of the longitudinal zone of reinforcement 2 is carried out, by points, by lines or by zones, in a continuous or discontinuous manner, longitudinally and/or transversely.

As required, a plurality of folding phases or of opening phases are carried out simultaneously or successively for a single longitudinal zone of the strip 1 and/or for different zones.

This results in the production of a plurality of longitudinal zones of reinforcement 2 in parallel and/or in series as has already been described, simultaneously or successively.

According to an optional alternative embodiment, there is inserted between two longitudinal zones of folding 3A, 3B a body 9 incorporated into the longitudinal zone of reinforcement 2, and in particular the body 9 is moved in a manner such as to engage between the two longitudinal zones of folding 3A, 3B which come to overlap. The method of insertion depends, in particular, on the nature of the body 9, for example on its fluid or solid state. In the case of a fluid body 9, this alternative embodiment is preferably combined with the embodiment including fixing of the longitudinal zone of reinforcement 2, in order that the latter should form a closed cavity capable of maintaining and enclosing the fluid body 9.

According to an optional alternative embodiment, one or more lines (or zones), continuous or otherwise, of weakness are produced on the longitudinal zone of reinforcement 2, particularly by punching.

Finally, and more generally, the specific method of producing the longitudinal zone of reinforcement 2 is associated with methods or method steps known per se for fashioning, treating, arranging, etc. . . . strips or sheaths, particularly cutting or transverse welding, transverse folding, stretching (or pre-stretching) or heat treatment.

With reference more specifically to the form of production by longitudinal folding, in order to cause two longitudinal zones of folding 3A, 3B to come to overlap, relative longitudinal movement is first caused between a longitudinal zone of the strip, particularly at least part of a first longitudinal zone of folding 3A, longitudinally along and against a first runner 11 which is longitudinally extended and limited and is situated on a first surface 6A of the strip 1, and a second longitudinal zone of the strip, particularly at least part of the second longitudinal zone of folding 3B, longitudinally along and against a second runner 12 which is longitudinally extended and limited and is situated on a second surface 6B of the strip 1; and, in combination, secondly, the first and second runners 11, 12 are arranged in a manner such, that at the start of the phase of longitudinal folding the first and second runners 11, 12 are positioned on either side of the strip 1, being respectively directed towards its first surface 6A and its second surface 6B, and that at the end of the longitudinal folding phase the first and second runners 11, 12 are positioned on either side of at least part of one of the longitudinal zones of folding, being respectively directed towards the second surface 6B and the first surface 6A of the strip 1.

With reference more specifically to the form of production by opening, the gusseted sheath is split longitudinally, the gusset being retained, and the sheath and the gusset are laid flat by opening the sheath thus split. The split is positioned at the desired point, bearing in mind the final position required for the longitudinal zone of reinforcement 2.

The invention likewise relates to a device for producing a longitudinal zone of reinforcement 2 on a strip. Such a device is generally characterized in that it permits or is designed to ensure the implementation of the method described above.

In a possible form of production, the device is designed for discontinuous operation and, to this end, possesses means for gripping a section of strip in different zones separated longitudinally and transversely — such as clamps or suction pads — and drive means for the relative displacement of these gripping means — such as endless chains or a jack — capable of bringing them into a position where the longitudinal zones of folding 3A, 3B . . . 3N are superposed.

In another, preferred form of production, the device is designed for continuous operation.

Such a device will now be described in the case of the form of production by longitudinal folding, with reference to FIGS. 9 and 13. Such a device possesses means for continuously feeding a strip lacking any reinforcement, for driving this strip with a longitudinal movement and for evacuating the reinforced strip 1; preferably means for maintaining the strip under tension in the longitudinal direction; at least a first and a second runner 11, 12, longitudinally extended and limited, which in their active state have their extreme downstream parts 13, 14 at least partly superposed and set at a distance apart from one another in the direction perpendicular to their plane, their function being to shape the strip which slides over them in a manner such that the superposed and spaced downstream parts 13, 14 produce the overlapping of the longitudinal zones of folding 3A, 3B. These runners 11, 12 are arranged in a manner such that their extreme upstream parts 15, 16 are at a distance from one another transversely. Moreover, the runners 11, 12 are arranged to move together transversely from their extreme upstream parts 15, 16 to their extreme downstream parts 13, 14. At least one runner is movable, particularly in its own plane, in a manner such that at least its extreme downstream part 13, 14 can be moved away from the extreme downstream part 14, 13 of the other runner 12, 11, drive means 17 being provided to displace the movable runner. For example, a runner is mounted to move pivotally about an axis 18 perpendicular to its own plane situated at the point of or in the vicinity of its extreme upstream part 15, 16, the drive means being constituted in particular by a jack, in particular a pneumatic jack.

According to a possible form of production, a runner 11, 12 takes the form of a blade arranged so that the strip can slide over its surface, this blade being limited by a longitudinal leading edge 19, which in particular is streamlined but non-cutting, onto which edge the strip is progessively applied and moved in order to form a longitudinal fold 7.

According to another possible form of production, capable of being combined with the preceding form, a runner takes the form of a blade arranged so that the strip can slide over its surface, this blade possessing a longitudinal projection 20 relative to its plane, acting as a shaper.

Finally, according to an optional alternative embodiment, the device possesses means 21 for inserting a body 9 between two longitudinal zones of folding 3A, 3B, these means consisting, in particular, of a runner with which the said body 9 interacts, this runner 21 having the function of guiding the said body 9 in order to bring it between the longitudinal zones of folding 3A, 3B.

Figure 9:
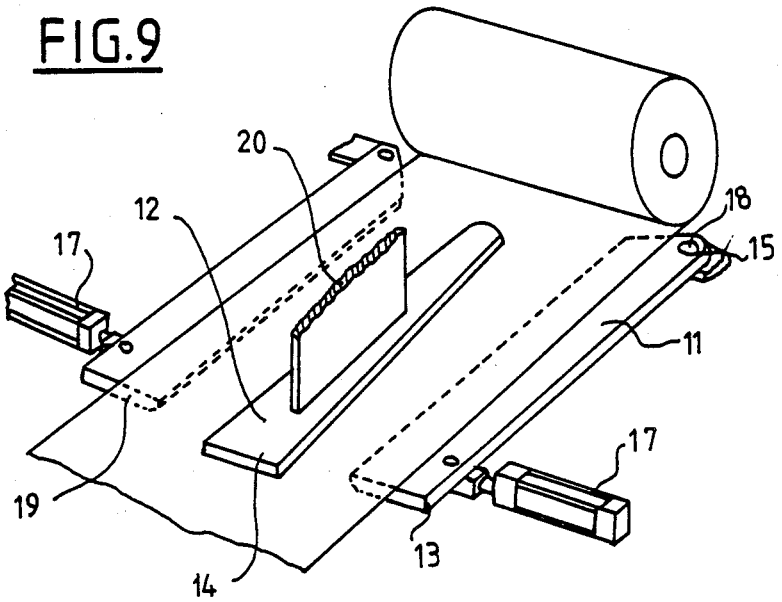
FIGS. 9 and 10 are two diagrammatic perspective views illustrating a possible device for producing a reinforcement in two different states.
Figure 10:
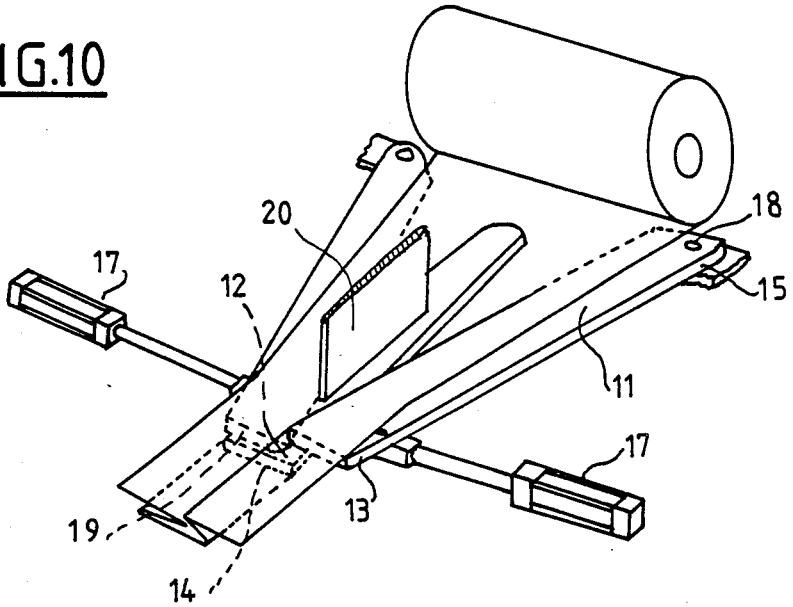

In the case of FIGS. 9 and 10, there are provided a fixed central runner having a longitudinal projection 20 and, on either side, two lateral movable runners of the type having a leading edge 29. The fixed central runner is situated on the side of a first surface 6A of the strip and the other two, movable runners on the side of a second surface 6B.

At rest (that is to say in the absence of formation of a longitudinal zone of reinforcement 2) the lateral runners are moved apart from one another, mutually parallel, having no effect on the film strip (FIG. 9).

In order to arrive at the operating position (FIG. 10), the drive means 17, such as the pneumatic jacks, are controlled in opposition to the axes 18 until the lateral runners are brought in line with and onto the central runner, these lateral runners being either juxtaposed in the transverse direction or even superposed (as in the figure). During their pivoting between the position of rest and the operating position, the lateral runners cause the desired displacement of the longitudinal zones of folding 3A, 3B to produce the desired longitudinal zone of reinforcement 2.

Figure 11:
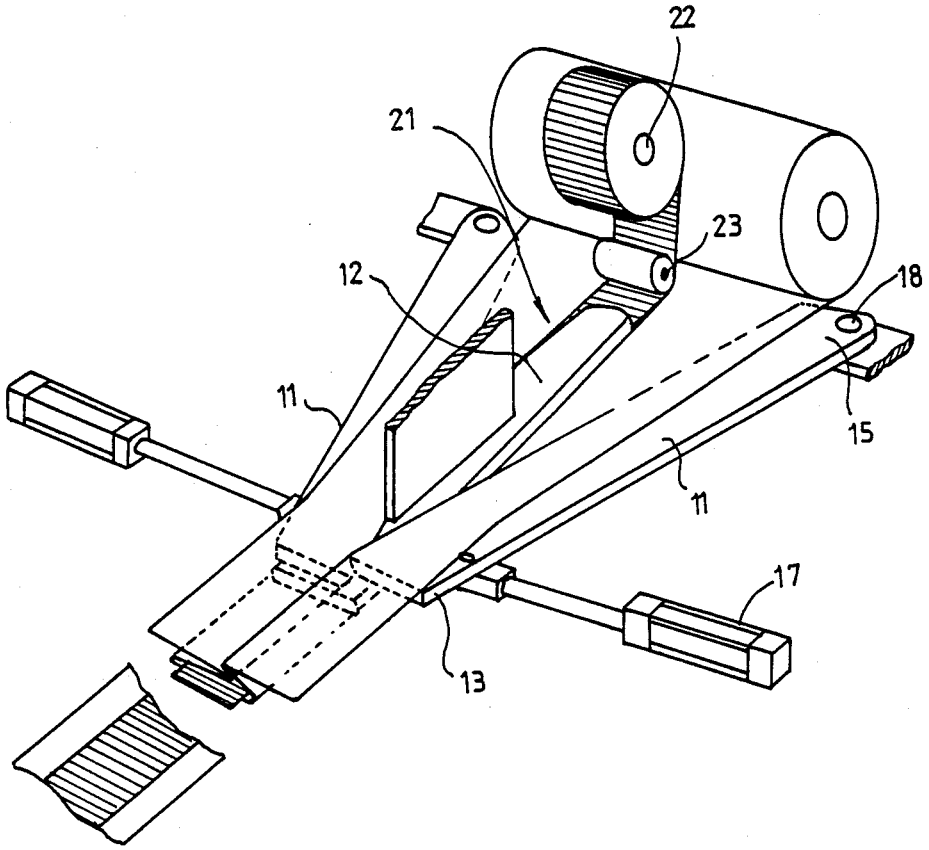
FIG. 11 is a diagrammatic perspective view illustrating an alternative embodiment of this device for the introduction of a body in strip form into the reinforcement.

In the case of FIG. 11, the device possesses means 21 for inserting a body 9 in the form of an insert strip. These means comprise a support 22 for this insert strip, a return roller 23 for feeding the coplanar insert strip to the central runner, and the central runner applying the insert strip to the longitudinal parts 3A, 3B, that is to say in the longitudinal zone of reinforcement 2.

Figure 12:
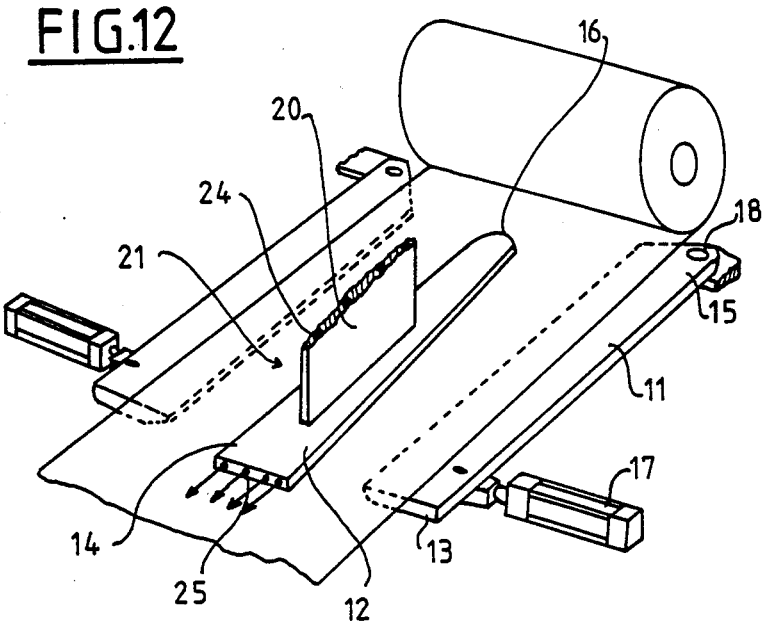
FIGS. 12 and 13 are two diagrammatic perspective views illustrating another alternative embodiment of the device for the introduction of a gaseous body into the reinforcement.
Figure 13:
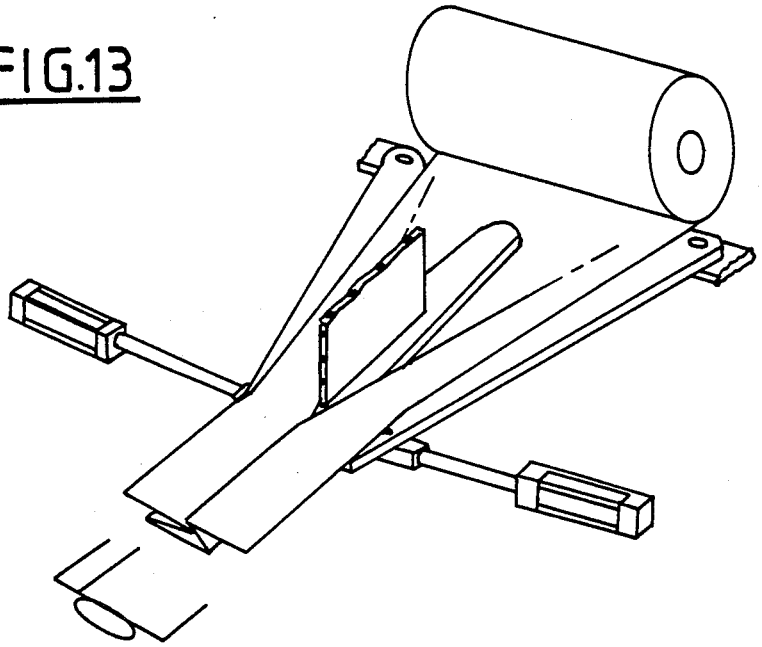
Figure 14:
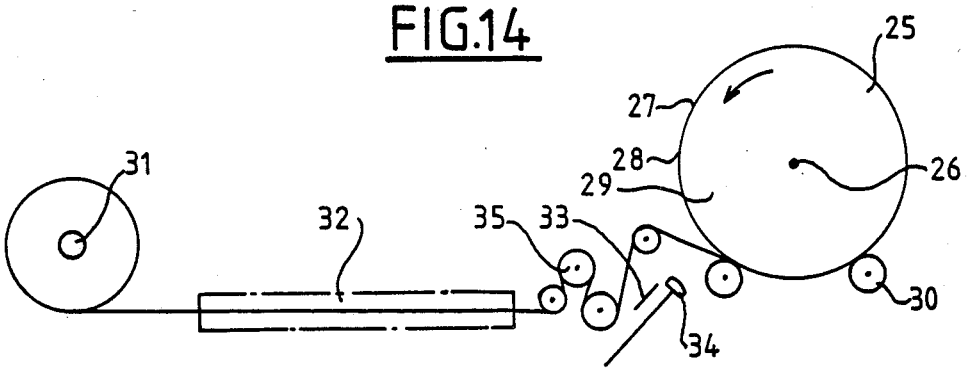
FIG. 14 is a diagrammatic view in elevation of an installation for packaging rolls of paper according to the invention.
Figure 15:
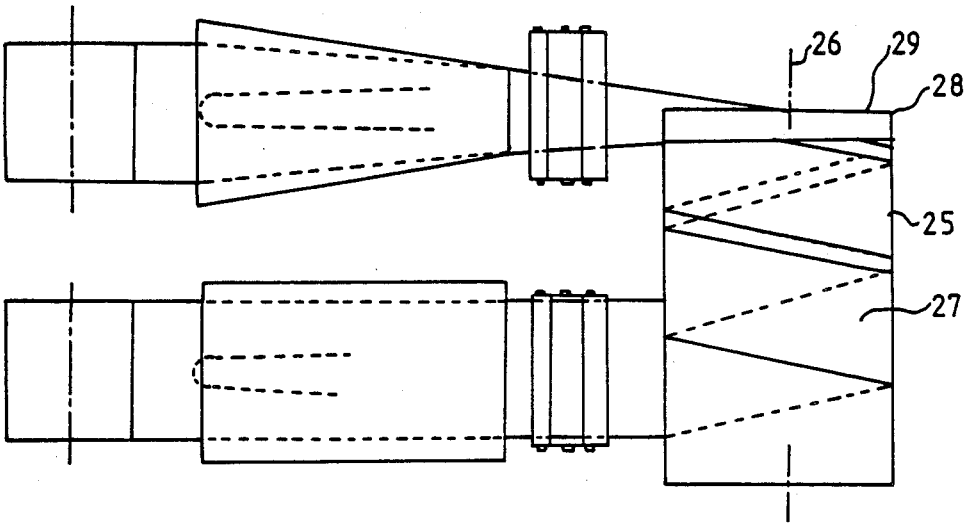
FIG. 15 is a plan view of this installation illustrating two possible states, respectively for the packaging of the cylindrical surface and of the end surface.
Figure 17:
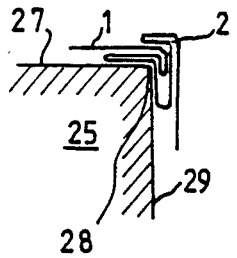
FIG. 17 is a diagrammatic view in radial section of the said packaged roll of paper of FIG. 16.
Figure 16:
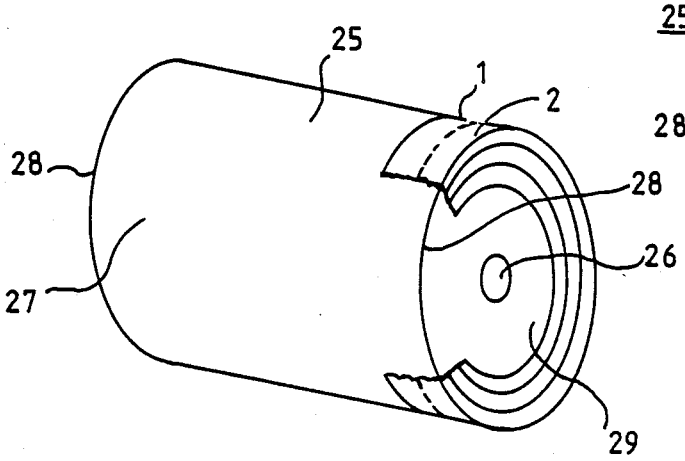
FIG. 16 is a perspective view of a roll of paper thus packaged in accordance with the invention.

In the case of FIGS. 12 and 13, the device possesses means 21 for inserting a fluid, particularly gaseous, body 9. This body 9 can be introduced through feed holes 24 provided in the projection 20 and communicating with outlet holes 25 in the blade of the runner which are situated in the zone of reinforcement 2. This device may then be associated with means of fixing, particularly welding, of the zone of reinforcement 2.

In the case of the form of production by longitudinal opening, the device possesses means for continuously feeding a strip in the form of a gusseted sheath, and of driving with longitudinal movement and of evacuating the reinforced strip 1 produced; means for longitudinally splitting the sheath and means for opening the sheath while retaining the gusset which is at least partly formed.

The means for splitting the sheath are constituted, for example, by a cutting blade. The means for opening the sheath are constituted, for example, by clamps which can be controlled to open and are carried by drive means such as an endless chain, jack, etc. ... or alternatively by endless belts oriented divergently to open the sheath.

It must be stressed that the devices described are in no way limiting, that they may comprise numerous alternative embodiments, and that some parts of them may be within the scope of the person skilled in the field of packaging.

The invention likewise relates, as a first specific case of packaging, to the packaging of a load of generally cylindrical shape, for example circular shape, in particular having its axis of revolution positioned horizontally, this load being in particular a roll of paper 25.

In this specific application, the film used is a stretchable film.

The method of packaging such a roll of paper 25 is such that generally, in at least a first phase, the strip is unrolled without a reinforcement being produced thereon and this unreinforced strip is applied to at least part of the cylindrical surface 27 of the load 25 and, in at least one second phase, the strip is unrolled and a longitudinal zone of reinforcement 2 is produced thereon (or, as an alternative embodiment, a strip having a premolded longitudinal reinforcement is used directly) and this reinforced strip 1 is applied with its longitudinal zone of reinforcement 2 to the end edge 28 of the cylindrical surface 27; at least during the second phase or phases, the film constituting the strip 1 is stretched or pre-stretched, the effect of which is to bring about the application of the strip 1 to the end face or faces 29 of the load 25; the film strip 1 is cut transversely and its extreme end part is fixed to the load 25 and/or to the intermediate part of the film strip 1 already applied to the load 25.

Such a method comprises, for example, a first initial phase followed by a second phase relating to a first end edge 28, followed by a first intermediate phase, followed by a second phase relating to a second end edge 28, followed by a first terminal phase. Preferably, the film is likewise stretched or pre-stretched during the first phase or phases. The longitudinal zone of reinforcement 2 produced during the second phase is preferably median. For example, a tiered longitudinal zone of reinforcement 2 is produced, comprising two lateral fringes having three layers and at least one central zone having at least five layers. Bearing in mind the application of the strip 1 to the load 25 resulting from the stretching, in a second phase the strip 1 is unrolled in a plane parallel to the axis 26 of the load 25. By way of indication, in a second phase, the width of the film strip 1 is reduced to a value of the order of one-third or one-quarter of the width of the unreinforced strip.

The method which has just been described can be the subject of numerous alternative embodiments which fall within the scope of the inventive concept described above. For example, the film strip can be applied only to one and/or the other of the edges 28; the strip can be cut and fixed between each turn of the strip; the strapping of the cylindrical surface 27 may be in a single layer or in a plurality of layers, straight or helical, with a strip whose useful width is equal to the axial length of the roll of paper 25 or equal only to a fraction of the latter; the strapping of the cylindrical surface 27 may be carried out with a reinforced strip 1; the film strip may cover all or only part, and if appropriate only a very small part, of the end faces 29.

According to an alternative embodiment, the method relates only to the positioning of the reinforced strip on one or, preferably, both edges 28, without the cylindrical surface 27 being covered.

According to another alternative embodiment, the film used is heat-shrinkable and the method includes no stretching or pre-stretching phase but a final heating phase.

It must be noted that the application of a single-thickness film strip to a paper roll 25 is a method generally known per se, as is an installation for implementing this method. The general constituent elements of this method and this installation, being known and within the scope of the person skilled in the art, are not described hereinafter. The invention therefore relates to the implementation of this method and device having a reinforced strip as indicated.

The invention likewise relates to a roll of paper 25 packaged in accordance with this method and therefore possessing at least one section of film strip 1 having a longitudinal zone of reinforcement 2 on at least one end edge 28. This strip is applied to the roll by stretching or heat-shrinking.

The invention likewise relates to an installation for implementing this method.

Such an installation possesses support means 30 for a roll of film strip having a horizontal axis, motorized support means 31 for the load 25, capable of enabling it to pivot about its horizontal axis of revolution 26; a device 32 for continuously producing a longitudinal zone of reinforcement 2 on the film strip, interposed between the support means 30, or the film strip roll itself, and the support means 31, or the load 25 itself, the film strip moving longitudinally in this device 32; transverse cutting means 33 for the film strip; means 34 for fixing the film strip to itself and/or to the load 25; means for ensuring a relative horizontal sliding of the device 32 and of the load support means 31 parallel to the axis 26; and film stretching or pre-stretching means 35.

As an alternative embodiment, such an installation likewise possesses means for controlling the device 32, particularly coupled with means for ensuring the relative sliding of the said device 32 and of the load support means 31, in a manner such that the said device 32 is active while the means for ensuring relative sliding bring the film strip into line with an end edge 28. The transverse cutting means 33 and fixing means 34, comprising at least one welding jaw, are situated from upstream to downstream in the vicinity of the load support means 31 or of the load 25.

Preferably, the stretching means 35 are film pre-stretching means placed downstream of the device 32 for producing the reinforcement.

In operation, the installation can be so arranged as to permit the packaging of all or part of the cylindrical surface 27, the strip then not being reinforced, the device 32 being inactive and the device 32 being active when it is desired to place the reinforced strip 1 on the edge 28.

This installation can likewise be the subject of alternative embodiments. For example, it may comprise two reinforced strips placed facing each edge 28, instead of a single strip slidingly displaced along the axis 26. It may comprise different strips for the covering of the cylindrical surface 26 and of an edge 28. The covering of the cylindrical surface can likewise utilize the reinforced strip 1, the device 32 being permanently active. The installation can utilize a heat-shrinkable film, the stretching or pre-stretching means 35 being superposed and the installation possessing heating means with a view to the heat-shrinkage of the film.

Finally, the invention relates, as a second specific case of packaging, to the packaging of a load having a generally parallelepipedal shape, in particular with its axis 37 placed vertically, this load being, in particular, a palettized load 36.

In this application the film used is likewise stretchable.

The method for packaging such a palettized load is such that, in at least one phase, the strip is unrolled and a longitudinal zone of reinforcement 2 is produced thereon, and this reinforced strip 1 is applied to the load 36 and, simultaneously, the film is stretched or pre-stretched. In order to apply the strip to the load 36, relative pivoting displacement of the load 36 in relation to the strip (particularly the roll of strip) is carried out, either with the roll having a fixed axle and the load pivoting (turntable machine), or with the roll having an axle mounted to pivot about a rotatably mounted arm and the load being fixed (turning arm machine).

More precisely, the longitudinal zone of reinforcement 2 is applied to the upper end edge 38 and/or the lower end edge 39 and/or to the lateral face 40 in the vicinity of the upper horizontal face 41 and/or the lower horizontal face 42; and/or to the corners 43; and/or at the junction of two superposed beds of elementary packs forming the load 36; and/or at regular intervals between the upper 41 and lower 42 horizontal faces, or according to any other desired configuration.

Figure 20:
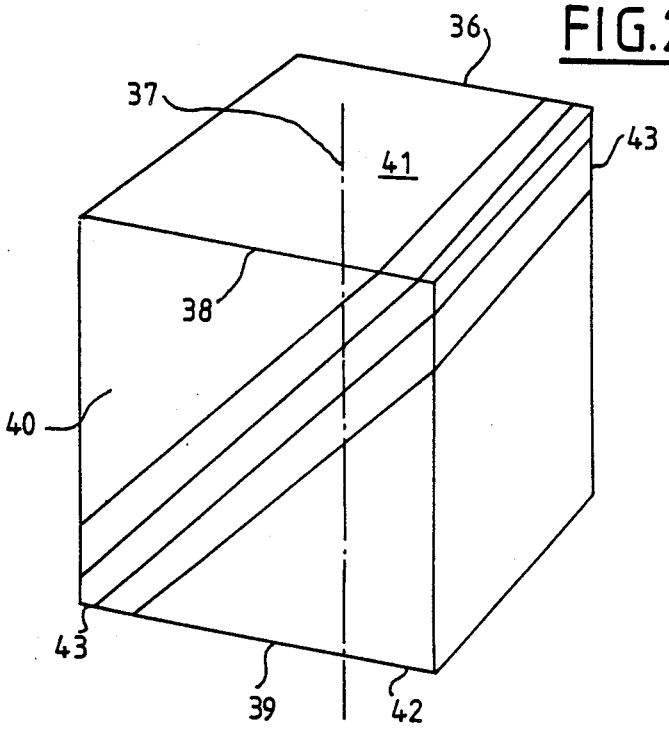
FIG. 20 is a perspective view of a palletized load packaged by means of the machine in FIGS. 18 and 19.
Figure 18:
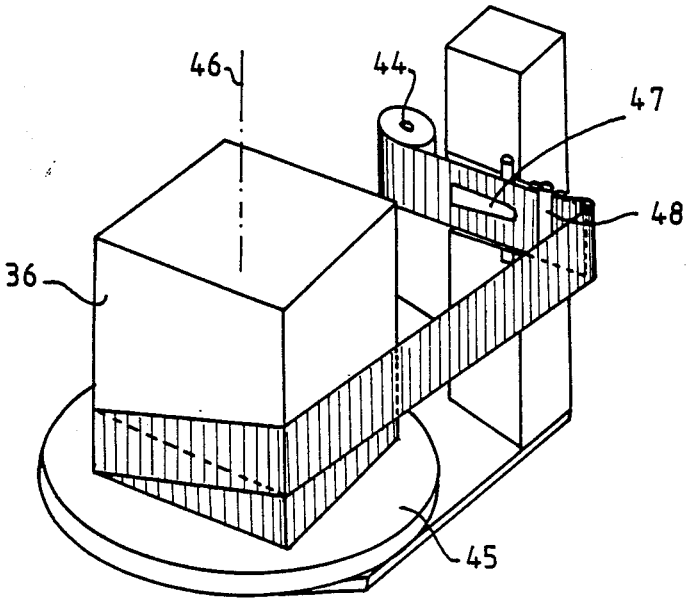
FIGS. 18 and 19 are two perspective views of a machine for strapping according to the invention in two possible states of operation.
Figure 19:
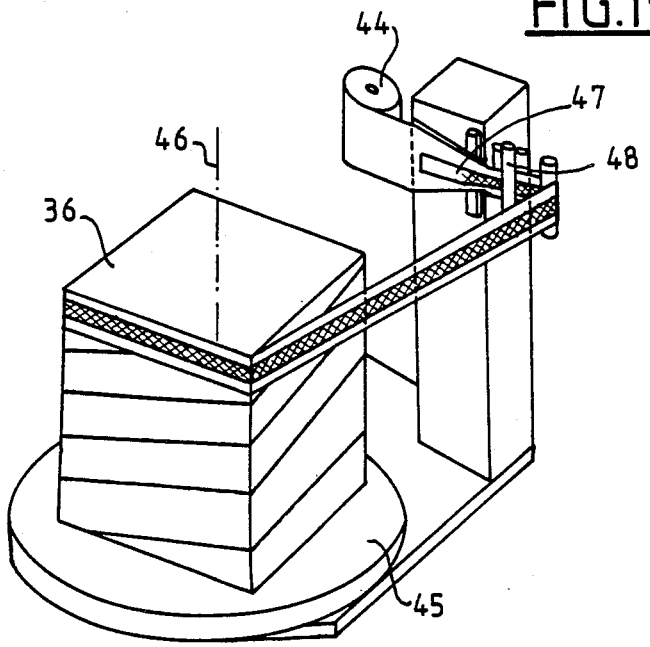

For example, this method makes it possible to produce a packaging according to FIG. 20 in which the film strip is placed diagonally on certain vertical faces of the load 36 between opposite top and bottom corners 43.

A packaging machine possesses means 44 for supporting a roll of film strip having a vertical axis; load support means 45; means for operating a relative displacement of the support means 44, or of the roll of film strip, and of the support means 45, or of the load 36, pivotably about a vertical axis 46; a device 47 for continuously producing a longitudinal zone of reinforcement 2 on the film strip, interposed between the support means 44, or the roll of film strip, and the support means 45, or the load 36 itself, the film strip passing longitudinally in this device 44, means for cutting the film strip transversely; means for fixing the film strip to itself and/or to the load; and means for stretching or pre-stretching the film 48.

The general structure of such a machine, having a turntable or a turning arm with an unreinforced strip, is well known to the person skilled in the art and is not described below.

As an alternative embodiment, the load 36 has an axis 37 which is horizontal rather than vertical, and the axis of the roll of film strip is likewise horizontal. This alternative embodiment is well suited to loads of great horizontal length. The other features described are likewise applicable to this alternative embodiment. As an alternative embodiment, the film is heat-shrinkable and not stretchable and the machine possesses integral or separate heating means such as a heating blower, heat-shrinking frame or heating tunnel.

We claim:

1. A method of packaging a load with flexible plastic strip having a longitudinal axis and a plurality of folding zones extending parallel to said longitudinal axis, said method comprising the steps of:

(1) unrolling said strip, initially lacking and reinforcement, in a longitudinal direction;

(2) in at least one phase of longitudinal folding, folding said strip in a transverse direction so that at least two adjacent folding zones flatly overlap one another to form at least one longitudinal fold constituting at least one part of a longitudinal reinforcement;

(3) displacing said reinforced strip in relation to said load to be packaged;

(4) applying said strip to said load; and (5) rigidly affixing said strip to itself and/or to said load.

2. The method of packaging as claimed in claim 1, further comprising the steps of using a heat-shrinkable plastic film and heating the strip after application to the load in order to cause its shrinkage.

3. The method of packaging as claimed in claim 1, further comprising the step of using a stretchable plastic film and stretching or pre-stretching the strip longitudinally during application to the load.

4. The method of packaging as claimed in claim 1, further comprising the step of alternating between at least one phase during which a zone of reinforcement is produced and at least one phase during which such a zone of reinforcement is not produced, the strip delivered and utilized thus lacking a zone of reinforcement.

5. The method of packaging as claimed in claim 1, further comprising the steps of:

where the load is of generally cylindrical shape, in particular with its axis of revolution positioned horizontally, and the film is of stretchable type, in at least one optical first phase, unrolling said strip, without producing any reinforcement thereon;

applying said unreinforced strip to at least a first part of the cylindrical surface of the load;

in at least one second phase, unrolling said strip and producing a longitudinal zone of reinforcement thereon;

applying said reinforced strip having a longitudinal zone of reinforcement to an end edge of the cylindrical surface at least during the second phase or phases;

stretching or pre-stretching said strip, causing the strips to be applied to the end face or faces of the load;

and cutting said strip of film transversely and fixing its extreme end part to the load and/or to a part of the film strip already applied to the load.

6. The method as claimed in claim 5, further comprising the steps of; unrolling said strip without a reinforcement being produced thereon and applying said strip to at least a second part of the cylindrical surface of the load;

unrolling said strip and producing a longitudinal zone of reinforcement thereon; and applying said strip with its longitudinal zone of reinforcement to a second end edge of the cylindrical surface.

7. The method as claimed in claim 5 further comprising the step of stretching or pre-stretching said film during the first phase or phases.

8. The method as claimed in claim 4, further comprising the step of producing a median longitudinal zone of reinforcement in a second phase.

9. A method for continuously producing a longitudinal reinforcement on a flexible continuous strip of plastic having a longitudinal axis and comprising at least two folding zones extending parallel to said longitudinal axis, said method comprising the steps of:

(1) unrolling said continuous strip, initially lacking any reinforcement, in a direction along said longitudinal axis;

(2) in at least one phase of longitudinal folding, folding said strip in a direction transverse to said longitudinal axis so that at least two adjacent folding zones flatly overlap one another to form at least one longitudinal fold constituting at least one part of said longitudinal zone of reinforcement.

10. The method for producing a longitudinal reinforcement as claimed in claim 9, further comprising the step of;

during and at least immediately after the phase of longitudinal folding, holding said strip flat under tension in the longitudinal direction.

11. The method for producing a longitudinal reinforcement as claimed in claim 9, further comprising the step of:

after the last of said at least one phase of longitudinal folding applying said strip having a longitudinal zone of reinforcement to and maintaining said strip on a roll on which the strip having a longitudinal zone of reinforcement is rolled, or at least one mobile roller of a machine making use of the strip having a longitudinal reinforcement and on which the strip moves, or a load which is to be covered by the strip having a longitudinal reinforcement, notably a load to be packaged.

12. The method for producing a longitudinal reinforcement as claimed in claim 9 further comprising the step of:

causing two folding zones to overlap by sliding them progressively on one another and relative to one another in the plane of the strip.

13. The method for producing a longitudinal reinforcement as claimed in claim 9, further comprising the step of:

causing two longitudinal folding zones to overlap by first causing relative movement between a first longitudinal zone of the strip, particularly at least part of a first longitudinal folding zone, longitudinally along and against a first runner which is longitudinally extended and limited and is situated on a first surface of the strip, and a second longitudinal zone of the strip, particularly at least part of a second longitudinal folding zone, longitudinally along and against a second runner which is longitudinally extended and limited and is situated on a second surface of the strip;

positioning said first and second runners at the start of the phase of longitudinal folding on either side of the strip, respectively directed towards said first surface of said strip and said second surface of said strips; and at the end of the longitudinal folding phase, positioning said first and second runners on either side of at least part of one of the longitudinal folding zones, respectively directed towards the second surface and the first surface of the strip.

14. The method for producing a longitudinal reinforcement as claimed in claim 9, further comprising the steps of:

incorporating a body into the longitudinal zone of reinforcement by inserting said body between two longitudinal folding zones and disposing said body in a manner such as to engage it between the two longitudinal zones of folding which come to overlap.

15. The method for producing a longitudinal reinforcement according to claim 9 further comprising the step of:

welding said longitudinal folding zones of the longitudinal zone of reinforcement by point, by lines or by zones, in a continuous or discontinuous manner, longitudinally and/or transversely.

16. A method for continuously producing a longitudinal reinforcement on a flexible strip of plastic film in the form of a sheath having a longitudinal gusset comprising the steps of:

(1) unrolling said strip in a longitudinal direction;

(2) splitting said sheath longitudinally;

(3) in at least one phase of longitudinal opening, opening said sheath in a transverse direction and retaining said gusset in manner such that said open sheath forms a flat strip and said longitudinal gusset constitutes said longitudinal zone of reinforcement.

17. The method for producing a longitudinal reinforcement as claimed in claim 16, further comprising the step of, after the phase of longitudinal opening, holding said strip flat under tension in the longitudinal direction.

18. The method for producing a longitudinal reinforcement as claimed in claim 16, further comprising the step of, after the last of said at least one phase of longitudinal opening, applying said strip having a longitudinal zone of reinforcement to and maintaining said strip on a roll on which the strip having a longitudinal zone of reinforcement is rolled, or at least one mobile roller of a machine making use of the strip having a longitudinal reinforcement and on which the strip moves, or a load which is to be covered by the strip having a longitudinal reinforcement, notably a load to be packaged.

19. A method of packaging a load with a flexible plastic strip rolled into a roll having a predetermined thickness and at least one previously produced longitudinal reinforcement comprising a plurality of flatly overlapping layers of said predetermined thickness, said method comprising the steps of:

(1) unrolling said strip;

(2) displacing said strip in relation to said load;

(3) applying said strip to said load; and (4rigidly affixing said strip to itself and/or to said load.

* * * * *